US010001304B2

(12) United States Patent
Nishioka et al.

(10) Patent No.: US 10,001,304 B2
(45) Date of Patent: Jun. 19, 2018

(54) HEAT MEDIUM RELAY UNIT AND AIR-CONDITIONING APPARATUS INCLUDING THE HEAT MEDIUM RELAY UNIT

(71) Applicant: Mitsubishi Electric Corporation, Tokyo (JP)

(72) Inventors: Koji Nishioka, Tokyo (JP); Yuji Motomura, Tokyo (JP); Daisuke Shimamoto, Tokyo (JP); Osamu Morimoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 104 days.

(21) Appl. No.: 14/783,572

(22) PCT Filed: May 31, 2013

(86) PCT No.: PCT/JP2013/065208
§ 371 (c)(1),
(2) Date: Oct. 9, 2015

(87) PCT Pub. No.: WO2014/192139
PCT Pub. Date: Dec. 4, 2014

(65) Prior Publication Data

US 2016/0084547 A1 Mar. 24, 2016

(51) Int. Cl.
*F28F 27/00* (2006.01)
*F25B 39/00* (2006.01)
(Continued)

(52) U.S. Cl.
CPC ..... *F25B 39/00* (2013.01); *F24F 3/065* (2013.01); *F24F 13/222* (2013.01); *F25B 39/02* (2013.01)

(58) Field of Classification Search
CPC ..... F25B 39/00; F25B 39/02; F25B 41/003; F25B 2313/0233; F24F 3/065;
(Continued)

(56) References Cited

U.S. PATENT DOCUMENTS 1,836,812 A * 12/1931 O'Brien ..... F24F 13/222 3/222
3,869,153 A * 3/1975 De Vincent ..... B60H 1/00571 285/124.3
(Continued)

FOREIGN PATENT DOCUMENTS

JP 04-006355 A 1/1992
JP 2009-236340 A 10/2009
JP 2013-011408 A 1/2013

OTHER PUBLICATIONS

International Search Report of the International Searching Authority dated Sep. 3, 2013 for the corresponding international application No. PCT/JP2013/065208 (and English translation).
(Continued)

*Primary Examiner* — Travis Ruby
(74) *Attorney, Agent, or Firm* — Posz Law Group, PLC

(57) ABSTRACT

In a heat medium relay unit, a drain pan is configured to have width and depth dimensions larger than dimensions of an outer shell of a heat medium relay unit main body. The outer shell includes side panels, upper frames, lower frames, and an upper end surface, the position of which is higher than those of upper end surfaces of the lower frames.

20 Claims, 7 Drawing Sheets

(51) Int. Cl.
*F24F 13/22* (2006.01)
*F24F 3/06* (2006.01)
*F25B 39/02* (2006.01)

(58) Field of Classification Search
CPC .. F24F 13/22; F24F 13/30; F24F 13/32; F24F 13/20; F24F 2221/14; F24F 2221/36; F24F 2013/227
USPC ..... 165/200
See application file for complete search history.

(56) References Cited

U.S. PATENT DOCUMENTS 4,167,200 A * 9/1979 Bouteille ..... F15B 13/04 137/596
4,770,341 A * 9/1988 Drake ..... F16L 41/03 137/271
5,390,660 A * 2/1995 Danielson ..... F24D 3/1058 126/271.2 R
5,743,102 A * 4/1998 Thomas ..... A47F 3/04 165/219
6,092,734 A * 7/2000 Rea ..... F24D 3/1066 237/56
6,170,270 B1 * 1/2001 Arshansky ..... F25D 17/02 62/185
6,345,770 B1 * 2/2002 Simensen ..... F24D 3/1075 237/69
6,880,351 B2 * 4/2005 Simadiris ..... B64D 11/04 62/185
2004/0078974 A1 * 4/2004 St. James ..... F16L 33/02 29/890.14
2004/0216784 A1 * 11/2004 Corbett, Jr. ..... F24D 3/1058 137/599.11
2005/0257843 A1 * 11/2005 Simensen ..... F17D 1/00 137/884
2007/0290586 A1 * 12/2007 Rosete ..... F24F 3/0442 312/236
2008/0271471 A1 * 11/2008 Nozawa ..... C23C 16/4411 62/179
2009/0025414 A1 * 1/2009 Koga ..... F24F 1/0007 62/263
2009/0049855 A1 * 2/2009 Murata ..... F24F 1/26 62/259.1
2009/0242172 A1 10/2009 Fukushima et al.
2010/0139294 A1 * 6/2010 Lowe ..... A61F 7/02 62/56

OTHER PUBLICATIONS

Office Action dated Jul. 5, 2016 issued in corresponding JP patent application No. 2015-519578 (and English tanslation).
Office Action dated Apr. 24, 2017 issued in corresponding Chinese patent application No. 201380076929.6 (and English translation).

* cited by examiner

HEAT MEDIUM RELAY UNIT AND AIR-CONDITIONING APPARATUS INCLUDING THE HEAT MEDIUM RELAY UNIT

CROSS REFERENCE TO RELATED APPLICATION

This application is a U.S. national stage application of International Application No. PCT/JP2013/065208 filed on May 31, 2013, the disclosure of which is incorporated herein by reference.

TECHNICAL FIELD

The present invention relates to a heat medium relay unit which is used in an air-conditioning apparatus typified by, for example, a multi-air-conditioning apparatus for a building and exchanges heat between two media, and an air-conditioning apparatus. In particular, the present invention relates to a heat medium relay unit having a casing structure that takes an installation environment of the heat medium relay unit into consideration, and an air-conditioning apparatus including the heat medium relay unit.

BACKGROUND ART

For example, an existing multi-air-conditioning apparatus for a building circulates refrigerant between an outdoor unit which is a heat source unit installed outside a building and indoor units installed within rooms of the building. Then, the refrigerant rejects and receives heat to heat and cool air with which an air-conditioning target space is cooled or heated. As refrigerant, for example, HFC (hydrofluorocarbon) refrigerant is used in many cases, and a multi-air-conditioning apparatus which uses natural refrigerant such as $CO_2$ has also been proposed.

In addition, there is a so-called total heat recovery type air-conditioning apparatus in which a flow division controller which controls and distributes flow of the refrigerant is connected between an outdoor unit and indoor units, and which exchanges heat to be released to the outside of a building via the outdoor unit, between the indoor units, and causes each indoor unit to independently perform cooling or heating in a single air-conditioning system (e.g., see Patent Literature 1).

Moreover, in an air-conditioning apparatus called a chiller, a heat source unit installed outside a building generates cooling energy or heating energy. A heat exchanger disposed within the heat source unit heats or cools water, an antifreezing solution, or the like (hereinafter, representatively referred to as water), and sends out the water to a fan coil unit, a panel heater, or the like installed within a room, to perform cooling or heating.

There is also an air-conditioning apparatus called a waste heat recovery type chiller in which four water pipes are connected between a heat source unit and an indoor unit, cooled or heated water is supplied simultaneously therethrough, and cooling or heating is freely selectable at the indoor unit.

In the air-conditioning apparatus described in Patent Literature 1, since the refrigerant is circulated to the indoor units, there is a possibility that the refrigerant leaks within the room. Meanwhile, in an air-conditioning apparatus such as a chiller or a waste heat recovery type chiller, refrigerant does not pass through the indoor unit, but it is necessary to send water from outside of the building to the indoor unit side. Thus, a water circulation path becomes long, and energy consumption such as water sending power is higher than that of the refrigerant, so that the efficiency is poor. In addition, in an air-conditioning apparatus such as a waste heat recovery type chiller, in order to allow cooling or heating to individually be selected for each indoor unit, the outdoor unit and each indoor unit have to be connected to each other via four pipes in total, and thus the installability further deteriorates.

From the above, it is thought that it is possible to solve the above-described problem if a method is established in which heat obtained by a total heat recovery type air-conditioning apparatus such as the air-conditioning apparatus described in Patent Literature 1 is given to water, and the water is supplied to each indoor unit.

Furthermore, the above-described method requires a device which exchanges heat between refrigerant and water, and a device which sends water to each indoor unit. In addition, in the case where these devices are individually installed, installation spaces, maintenance spaces, and an operation of connecting pipes which connect these devices to each other, an operation for heat insulation, and the like are required, so that the installability deteriorates. Thus, these devices are desired to be integrated with each other (e.g., see Patent Literature 2). In addition, these devices are installed above a ceiling in many cases.

CITATION LIST

Patent Literature

Patent Literature 1: Japanese Unexamined Patent Application Publication No. 4-006355 (page 5, FIG. 1, etc.)

Patent Literature 2: Japanese Unexamined Patent Application Publication No. 2013-11408 (pages 4 and 5, FIG. 1, etc.)

SUMMARY OF INVENTION

Technical Problem

As described above, when installation into a narrow space above a ceiling is taken into consideration, it is necessary to make each device compact. However, since water having a higher heat capacity than that of refrigerant is used as a heat medium, dew condensation water easily occurs on the surface of each device. As a countermeasure against this, for example, it is considered that many heat insulators are used inside and outside each device, or it is considered at present that a drain pan for receiving dew condensation water from the outer surface of each device is individually provided for each device. However, with either countermeasure, deterioration of the productivity, the installability, and the maintainability due to an increase in the size of each device or installation space is unavoidable.

In addition, since the refrigerant and water having a design pressure different from that of the refrigerant contact each other via the heat exchanger, if a gap occurs in a simple water circuit connection portion, or if pressure leak occurs from the refrigerant circuit side to the water circuit side, water leak occurs. When a possibility of coming out of leak water to the inner surface of a casing is taken into consideration, it is necessary to use many sealing materials which seal joints between components which form the casing, but the productivity deteriorates. In addition, in order to ensure water tightness again after execution of maintenance, a lot of time is taken.

The present invention has been made in order to solve the above-described problems, and an object of the present invention is to provide a heat medium relay unit having a structure which is able to receive dew condensation water generated on the surface of the unit and water leaking from inside of the unit, without using many heat insulators or sealing materials, and an air-conditioning apparatus including the heat medium relay unit.

Solution to Problem

A heat medium relay unit according to the present invention includes a primary heat medium side assembly, a secondary heat medium flow path switching device assembly, and a drain pan, the primary heat medium side assembly including a heat exchanger configured to exchange heat between a primary heat medium and a secondary heat medium, the primary heat medium circulating between the heat medium relay unit and an outdoor unit connected by a pipe, the secondary heat medium circulating between the heat medium relay unit and an indoor unit connected by a pipe; a secondary heat medium sending device configured to pump the secondary heat medium for circulating between the heat medium relay unit and the indoor unit; and a primary-side casing portion including side panels covering side surfaces of the heat medium relay unit, lower frames that connect between the side panels and to which the secondary heat medium sending device is attached, and a lower side support plate configured to receive the heat exchanger thereon, the secondary heat medium flow path switching device assembly including a secondary heat medium flow path switching device configured to select or mix the secondary heat medium flowing through a plurality of flow paths, and causing the secondary heat medium to flow into and out of the indoor unit; and a secondary-side casing portion including upper frames connecting between the side panels, an upper side support plate configured to fix the heat exchanger, an inner panel attached to the upper frames, and a presser plate and a placing plate attached to the inner panel to fix the secondary heat medium flow path switching device, the drain pan being configured to have width and depth dimensions larger than dimensions of an outer shell of a heat medium relay unit main body, the outer shell including the side panels, the upper frames, and the lower frames, and an upper end surface whose position is higher than that of an upper end surface of the lower frames.

An air-conditioning apparatus according to the present invention includes: the above-described heat medium relay unit; an outdoor unit configured to supply cooling energy or heating energy; and an indoor unit configured to execute air-conditioning of an air-conditioning target space with the cooling energy or the heating energy supplied from the outdoor unit, and the heat medium relay unit is interposed between the outdoor unit and the indoor unit.

Advantageous Effects of Invention

In the heat medium relay unit according to the present invention, since the width and depth dimensions of the drain pan are made larger than those of the heat medium relay unit main body, it is possible to receive, by the drain pan, dew condensation water generated on the outer surface of the heat medium relay unit. In addition, in the heat medium relay unit according to the present invention, the height of a rising portion of the drain pan is higher than that of the lower frame. Thus, even if leak water generated inside the heat medium relay unit comes out to the outside of the heat medium relay unit via a joint between the lower frames and an outer shell component covering the side surface of the heat medium relay unit main body, such as a service panel, it is possible to similarly receive the water by the drain pan. Therefore, in the heat medium relay unit according to the present invention, even with a structure which is able to receive dew condensation water generated on the surface of the unit and leak water from the inside of the unit, it is possible to reduce a heat insulator or a sealing material in the heat medium relay unit itself. As a result, it is possible to easily perform production and maintenance.

In the air-conditioning apparatus according to the present invention, since the heat medium relay unit is included, it is possible to easily perform production and maintenance. In addition, flexibility in the installation location of the heat medium relay unit increases, and it is made possible to apply the air-conditioning apparatus to various buildings.

DESCRIPTION OF EMBODIMENTS

Figure 1:
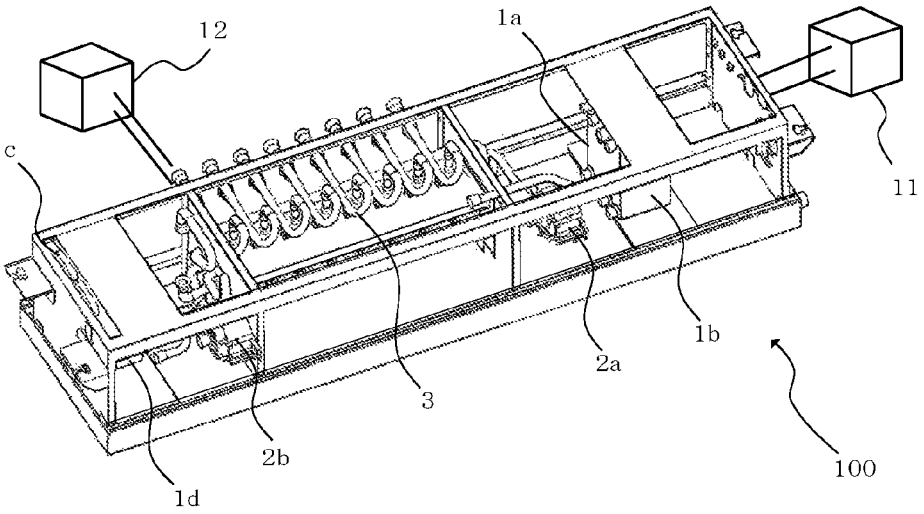
FIG. 1 is an overall structure diagram of a heat medium relay unit according to Embodiment 1 of the present invention.

Hereinafter, embodiments of the present invention will be described based on the drawings. It should be noted that the relationship of the size of each constituent element in the drawings described below including FIG. 1 may be different from actual size. In the drawings described below including FIG. 1, portions designated by the same reference signs are the same or equivalent portions, and the same applies to the entire specification. In addition, the forms of constituent elements described in the entire specification are merely illustrative and not limited to these descriptions.

Embodiment 1

FIG. 1 is an overall structure diagram of a heat medium relay unit 100 according to Embodiment 1 of the present invention. First, the configurations of functional components of the heat medium relay unit 100 will be described. The heat medium relay unit 100 of Embodiment 1 includes heat exchangers 1*a*, 1*b*, 1*c*, and 1*d*, secondary heat medium sending devices 2*a* and 2*b*, and a secondary heat medium flow path switching device 3 as functional components. These functional components are provided in a casing 100*a*. As shown in FIG. 1, the heat medium relay unit 100 is provided between an outdoor unit 11 and an indoor unit 12, and has a function of supplying heating energy or cooling energy generated by the outdoor unit 11, in response to a request from the indoor unit 12.

(Heat Exchangers 1*a*, 1*b*, 1*c*, and 1*d*)

The heat exchangers 1*a*, 1*b*, 1*c*, and 1*d* serve to exchange heat between a primary heat medium such as refrigerant which is sent from the outdoor unit 11, and a secondary heat medium, thereby heating or cooling the secondary heat medium. Here, the heat exchangers 1*a* and 1*b* and the heat exchangers 1*c* and 1*d* are separately installed, for example, one set of heat exchangers are referred to as heating side heat exchangers, and the other set of heat exchangers are referred to as cooling side heat exchangers. In some cases, both sets are able to serve to heat or cool the secondary heat medium. In addition, here, four heat exchangers, the heat exchangers 1*a*, 1*b*, 1*c*, and 1*d*, are included, but the configuration does not need to be limited thereto. For example, in the case where the heat medium relay unit 100 of the Embodiment 1 is installed at a ceiling or the like, the heat medium relay unit 100 is able to be configured with, for example, an even number of heat exchangers which is equal to or higher than 2, as long as it is possible to keep balance in terms of weight.

(Secondary Heat Medium Sending Devices 2*a* and 2*b*)

The secondary heat medium sending devices 2*a* and 2*b* serve to pump and send the heated or cooled secondary heat medium to a plurality of flow paths to circulate the secondary heat medium. Each of the secondary heat medium sending devices 2*a* and 2*b* may be composed of, for example, a pump or the like.

(Secondary Heat Medium Flow Path Switching Device 3)

The secondary heat medium flow path switching device 3 serves to perform switching for causing one or more secondary heat media, of the secondary heat media from the plurality of flow paths, to flow into or out of a heat exchanger of each indoor unit 12.

(Outdoor Unit 11)

The outdoor unit 11, together with the heat medium relay unit 100, forms an air-conditioning apparatus (described in Embodiment 2).

The outdoor unit 11 is connected to the heat medium relay unit 100 by two pipes in order to circulate the primary heat medium therethrough. The outdoor unit 11 includes a compressor for circulating the primary heat medium such as refrigerant, an outdoor side heat exchanger which serves as a condenser or an evaporator, and the like (not shown).

(Indoor Unit 12)

The indoor unit 12, together with the heat medium relay unit 100, also forms the air-conditioning apparatus (described in Embodiment 2).

The indoor unit 12 is also connected to the heat medium relay unit 100 by two pipes. The indoor unit 12 includes, for example, a use side heat exchanger which exchanges heat between air in an air-conditioning target space and the secondary heat medium. In FIG. 1, the heat medium relay unit 100 is connected to the single indoor unit 12 by pipes, but is connectable to a plurality of indoor units 12 according to the number of sets of the secondary heat medium flow path switching device 3 described later.

Figure 2:
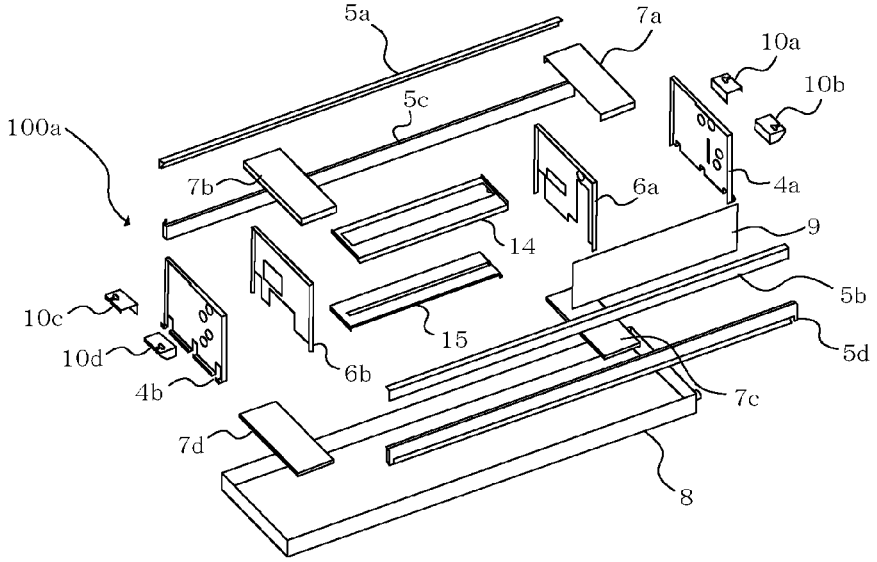
FIG. 2 is an exploded diagram of only components (casing components) forming a casing of the heat medium relay unit according to Embodiment 1 of the present invention.

FIG. 2 is an exploded diagram of only components (casing components) forming the casing 100*a* of the heat medium relay unit 100. In the casing 100*a*, for example, side panels 4*a* and 4*b*, as side walls, cover casing side surfaces. Frames 5*a*, 5*b*, 5*c*, and 5*d* serve as a skeleton that connects between the side panels 4*a* and 4*b*. The frames 5*a* and 5*b* are upper frames, and the frames 5*c* and 5*d* are lower frames. Inner panels 6*a* and 6*b* are provided at the inner side (center side) relative to the side panels 4*a* and 4*b*, for example, in order to support the secondary heat medium flow path switching device 3.

In addition, the inner panels 6*a* and 6*b* also serve to fix the frames 5*a*, 5*b*, 5*c*, and 5*d* to each other, and a presser plate 14 and a placing plate 15 which fix the secondary heat medium flow path switching device 3 serve to fix the inner panels 6*a* and 6*b* to each other. Thus, reinforcement which makes the entirety of the casing 100*a* into a lattice shape is made, so that it is possible to ensure desired rigidity.

Support plates 7*a*, 7*b*, 7*c*, and 7*d* support, for example, the heat exchangers 1*a*, 1*b*, 1*c*, and 1*d* shown in FIG. 1. In addition, the support plates 7*a* and 7*b* fix the frames 5*a* and 5*b* to each other, and the support plates 7*c* and 7*d* fix the frames 5*c* and 5*d* to each other to more firmly fix the frames to each other, thereby reinforcing the casing 100*a*.

A drain pan 8 serves to receive water (e.g., dew condensation water, leak water, etc.) generated at the casing 100*a*. The drain pan 8 has width and depth dimensions larger than those of a heat medium relay unit main body outer shell portion which is formed of the side panels 4*a* and 4*b* and the frames 5*a*, 5*b*, 5*c*, and 5*d*. After assembling, the upper end surface of the drain pan 8 is located higher than the upper end surface of the lower frames (frames 5*c* and 5*d*). This is for receiving dew condensation water on the outer surface of the heat medium relay unit 100, and leak water coming out through a joint between the frame 5*c* or 5*d* and an outer shell component covering a side surface of a heat medium relay unit main body, such as the service panel 9.

As a method for mounting the drain pan 8, in Embodiment 1, for example, a structure may be provided in which square holes of the drain pan 8 are hooked on claw portions provided at left and right portions of the lower frames 5*d*, and then the drain pan 8 is fixed to lock holes provided in a bent portion of the lower frames 5*c*. However, the method for mounting the drain pan 8 is not limited to this, as long as it is possible to provide a gap which allows dew condensation water and leak water to flow therethrough, between the drain pan 8; and the side panels 4*a* and 4*b* and the lower frames 5*c* and 5*d*.

In addition, bent portions are provided at the lower ends of the side panels 4*a* and 4*b* and the upper and lower ends of the lower frames 5*c* and 5*d* so as to extend outward as seen from the heat medium relay unit 100. This is for ensuring desired rigidity of each of the side panels 4*a* and 4*b* and the lower frames 5*c* and 5*d*. Furthermore, these bent portions serve as a spacer for ensuring a gap between the drain pan 8; and the side panels 4*a* and 4*b* and the lower frames 5*c* and 5*d*, and also serve to ensure desired rigidity as a frame of the drain pan 8 by causing these bent portions to extend along four sides of the drain pan 8. These bent portions are intended to eliminate the need for imparting rigidity to the drain pan 8 by a rib or by increasing the thickness thereof.

In order to make drainability better, the drain pan 8 is provided with a slope at the side of a drain pipe provided at one side, but a structure may be provided in which drain pipes are provided at both sides, the position of the drain pipe is changed, and the drain pan 8 is made horizontal, in accordance with the amount of dew condensation water, the amount of leak water, and the installation environment.

Hanging metal fittings 10*a*, 10*b*, 10*c*, and 10*d* will be described with reference to FIG. 4.

A water path for dew condensation water and leak water will be described.

If dew condensation water generated on the outer surface of the heat medium relay unit 100 is generated on wall surfaces of the side panels 4*a* and 4*b*, the water flows downward therefrom via openings provided between the drain pan 8 and end portions of the lower frames 5*c* and 5*d*, and is exhausted through the drain pipe.

In addition, dew condensation water generated within the heat medium relay unit 100 flows to the outside through openings provided at the lower ends of the side panels 4*a* and 4*b*, and is exhausted through the openings between the lower frames 5*c* and 5*d* and the drain pan 8, and the drain pipe.

Furthermore, dew condensation water generated on an outer shell component covering a side surface such as the service panel 9, other than the side panels 4*a* and 4*b*, drops from the frames 5*c* and 5*d* into the drain pan 8 and is exhausted through the drain pipe. Meanwhile, dew condensation water that drops at the side opposite to the drain pipe, for example, at the lower frames 5*d* side, flows from the opening between the frame 5*d* and the drain pan 8, passes in front of the side panels 4*a* and 4*b* and through the opening between the frame 5*c* and the drain pan 8, and is exhausted through the drain pipe.

Moreover, leak water coming out of the inside of the heat medium relay unit 100, for example, through joints between an outer shell component such as the service panel 9 and the lower frames 5*c* and 5*d* hits against the side wall of the drain pan 8, then passes through the same flow path as for the dew condensation water, and is exhausted through the drain pipe.

Figure 3:
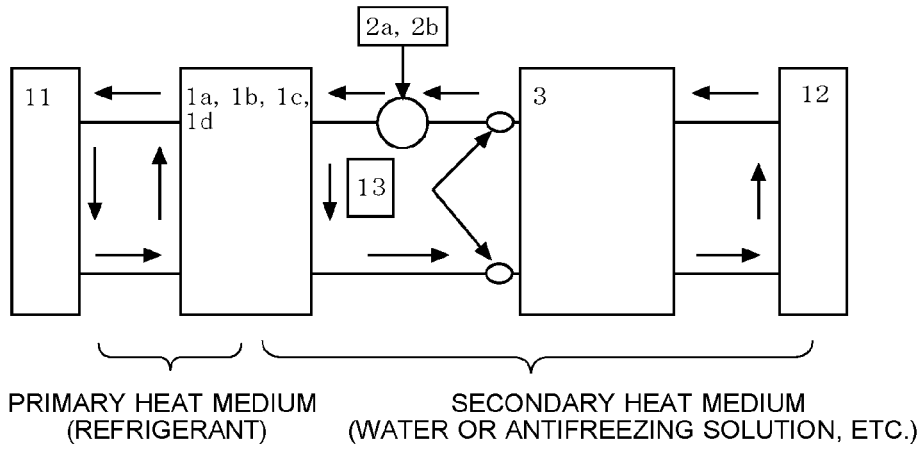
FIG. 3 is a diagram schematically showing a circuit in which a heat medium in an air-conditioning apparatus using the heat medium relay unit according to Embodiment 1 of the present invention circulates.

FIG. 3 is a diagram schematically showing a circuit in which a heat medium in an air-conditioning apparatus using the heat medium relay unit 100 circulates. Next, flow of each heat medium will be described.

First, the primary heat medium rejects or receives heat at the outdoor unit 11 and flows into the heat medium relay unit 100. Then, the primary heat medium heats or cools the secondary heat medium through heat exchange at the heat exchangers 1*a*, 1*b*, 1*c*, and 1*d*, then flows out of the heat medium relay unit 100, and returns to the outdoor unit 11 again.

In addition, the secondary heat medium circulates between the heat medium relay unit 100 and the indoor unit 12 by the secondary heat medium sending devices 2*a* and 2*b*. At that time, the secondary heat medium is heated or cooled by the primary heat medium at the heat exchangers 1*a*, 1*b*, 1*c*, and 1*d*. Then, the secondary heat medium passes through the secondary heat medium flow path switching device 3, rejects heat to or receives heat from air in a target space through heat exchange at the use side heat exchangers of one or more indoor units 12, then passes through the secondary heat medium flow path switching device 3, and returns to the heat exchangers 1*a*, 1*b*, 1*c*, and 1*d* again. Here, as described later, pipe-connection between the heat exchangers 1*a*, 1*b*, 1*c*, and 1*d* and the secondary heat medium flow path switching device 3 is made with simple joints 13.

Next, a method for assembling the heat medium relay unit 100 of Embodiment 1 will be described. As described above, two types of heat media flow in the heat medium relay unit 100, and the primary heat medium is refrigerant or the like which is a high-pressure gas which is compressed and injected into a heat medium circuit. Thus, when the heat medium relay unit 100 and the outdoor unit 11 are connected to each other by a metal pipe and the pipe and a functional component within the heat medium relay unit 100 are joined, it is necessary to perform brazing.

On the other hand, for example, regarding functional components forming the secondary heat medium flow path switching device 3, outer shells thereof are produced by a resin material in most cases. Thus, there is a possibility that the functional components are burnt when being touched by flame caused by a burner or the like during brazing. In addition, a switching valve is included within each functional component forming the secondary heat medium flow path switching device 3, and thus there is a possibility that malfunction occurs when an oxide film generated on a brazed portion is entrapped. Furthermore, for example, in conducting a water tightness test or the like for the secondary heat medium flow path switching device 3, if a test pressure for the primary heat medium side is applied by accident, there is a risk of collapse of the secondary heat medium flow path switching device 3. Thus, assembling of the secondary heat medium flow path switching device 3, a water tightness test, and the like are desirably conducted separately from assembling of functional components at the primary heat medium side, an air tightness test, and the like.

Figure 4:
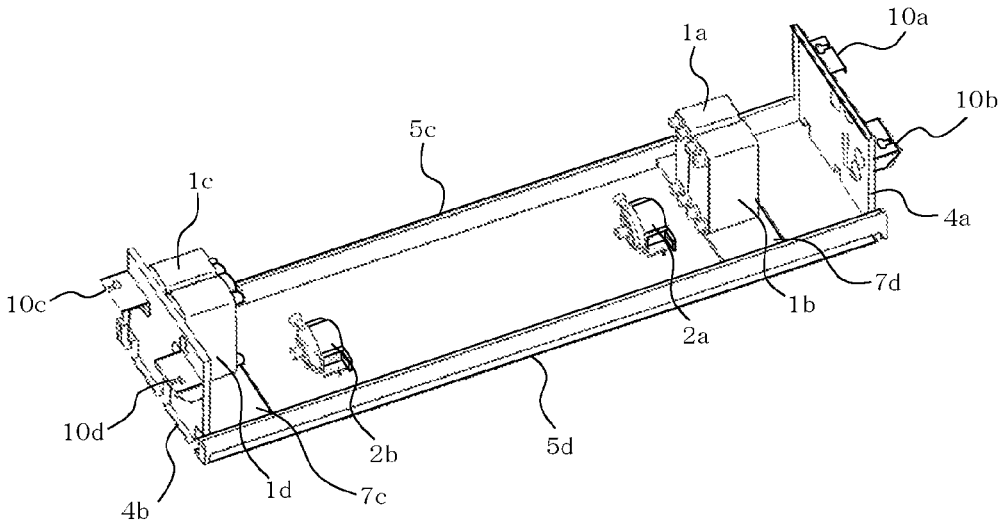
FIG. 4 is a structure diagram of a primary heat medium side assembly of the heat medium relay unit according to Embodiment 1 of the present invention.

FIG. 4 is a structure diagram of a primary heat medium side assembly of the heat medium relay unit 100. First, the component configuration and an assembling method of the primary heat medium side assembly in the heat medium relay unit 100 according to Embodiment 1 will be described. The primary heat medium side assembly includes: the heat exchangers 1*a*, 1*b*, 1*c*, and 1*d*; the secondary heat medium sending devices 2*a* and 2*b*; the side panels 4*a* and 4*b*, the frames 5*c* and 5*d*, and the support plates 7*c* and 7*d* which are to be a primary-side casing portion; and the hanging metal fittings 10*a*, 10*b*, 10*c*, and 10*d*.

The support plates 7*c* and 7*d* are disposed close to the side panels 4*a* and 4*b*, respectively. For example, the heat exchangers 1*a*, 1*b*, 1*c*, and 1*d* placed on the support plates 7*c* and 7*d* are heavy components. In addition, as shown in FIG. 1 and the like, the heat medium relay unit 100 has a horizontally long rectangular parallelepiped shape (the length thereof is increased as the number of the indoor units 12 to be connected is increased). Thus, if the heavy components are disposed close to the center of the heat medium relay unit 100, due to the hanging metal fittings 10*a*, 10*b*, 10*c*, and 10*d* provided at positions close to the vertices of the rectangular parallelepiped, in mounting and installing to a ceiling, a load is applied to the frames 5*c* and 5*d*, and there is a possibility that the device itself deforms, such as occurrence of bending.

Thus, in Embodiment 1, the support plates 7*c* and 7*d* are disposed close to the side panels 4*a* and 4*b*, whereby a load caused by the heat exchangers 1*a*, 1*b*, 1*c*, and 1*d* is dispersed. In addition, by disposing the heat exchangers 1*a*, 1*b*, 1*c*, and 1*d* at both ends of the heat medium relay unit 100, it is possible to keep balance and maintain the position of the center of gravity of the heat medium relay unit 100 at the center of the heat medium relay unit 100. This also serves to prevent load collapse during storage or prevent drop trouble caused due to a fork lift or the like during transfer.

Next, an example of a method for assembling the primary heat medium assembly will be described.

First, the hanging metal fittings 10*a*, 10*b*, 10*c*, and 10*d* are attached to the side panels 4*a* and 4*b*. Then, the frames 5*c* and 5*d* are attached between the side panels 4*a* and 4*b*, then the support plates 7*c* and 7*d* are attached, thereby completing a casing portion for the primary heat medium side assembly.

Next, the heat exchangers 1*a*, 1*b*, 1*c*, and 1*d* are placed (attached) on the support plates 7*c* and 7*d*, pipe connection ports of the heat exchangers 1*a*, 1*b*, 1*c*, and 1*d* and the pipes are brazed. Thereafter, the secondary heat medium sending devices 2*a* and 2*b* are attached to the frames 5*c* and 5*d*. Then, an air tightness test or the like is conducted on a circuit which includes the heat exchangers 1*a*, 1*b*, 1*c*, and 1*d* and connection pipes and in which the primary heat medium circulates, to complete the primary heat medium side assembly.

Here, the reason why the side panels 4*a* and 4*b* are assembled to form the primary heat medium side assembly will be described. For example, in the heat medium relay unit 100 hanged from the ceiling, in order to facilitate maintenance of the primary heat medium side assembly, the heat exchangers 1*a*, 1*b*, 1*c*, and 1*d* are disposed at the lower side of the heat medium relay unit 100. Thus, in brazing the pipe connection ports and the pipes at the lower side of the heat exchangers 1*a*, 1*b*, 1*c*, and 1*d*, it is made difficult to apply flame of a burner.

By attaching and assembling not only the frames 5*c* and 5*d* and the support plates 7*c* and 7*d* but also the side panels 4*a* and 4*b*, the rigidity of the primary heat medium side assembly increases, and, for example, in brazing the pipe connection ports and the pipes at the lower side of the heat exchangers 1*a*, 1*b*, 1*c*, and 1*d*, it is possible to rise (lift) the assembly from a workbench. Thus, the primary heat medium side assembly serves as a jig which is able to increase assembly workability, so that it is possible to make it easy to apply flame of a burner in brazing the pipe connection ports and the pipes.

Figure 5:
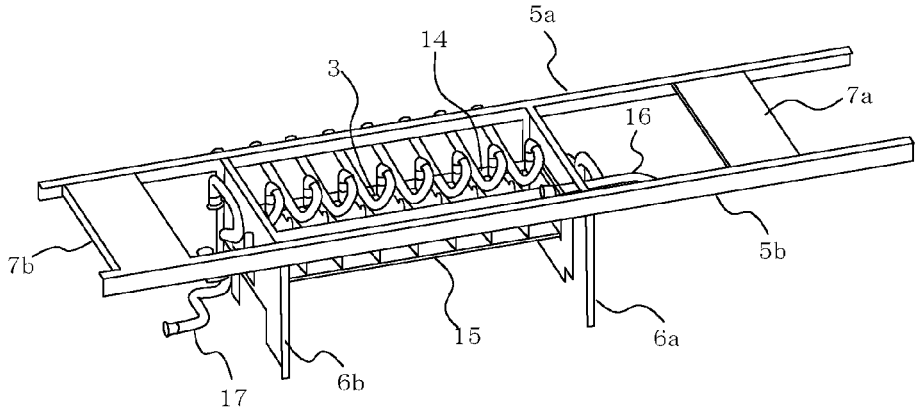
FIG. 5 is a structure diagram of a secondary heat medium flow path switching device assembly of the heat medium relay unit according to Embodiment 1 of the present invention.

FIG. 5 is a structure diagram of a secondary heat medium flow path switching device assembly of the heat medium relay unit 100. Next, the component configuration and an assembling method of the secondary heat medium flow path switching device assembly of the heat medium relay unit 100 according to Embodiment 1 will be described. The secondary heat medium flow path switching device assembly includes the secondary heat medium flow path switching device 3, communication pipes 16 and 17 extending to the heat exchangers 1*a*, 1*b*, 1*c*, and 1*d*, the frames 5*a* and 5*b* which are to be a secondary-side casing portion, the inner panels 6*a* and 6*b*, the support plates 7*a* and 7*b*, the presser plate 14, and the placing plate 15.

Figure 6:
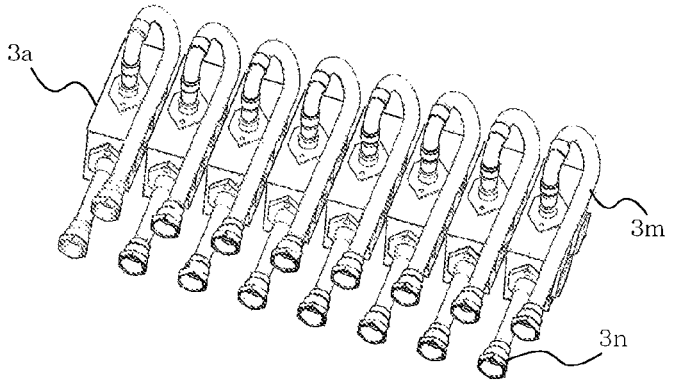
FIG. 6 is an overall structure diagram of a secondary heat medium flow path switching device 3 of the heat medium relay unit according to Embodiment 1 of the present invention.

FIG. 6 is an overall structure diagram of the secondary heat medium flow path switching device 3 of the heat medium relay unit 100. In the secondary heat medium flow path switching device 3 of the heat medium relay unit 100 according to Embodiment 1, for example, three-way valves 3*a* which are to be switching means are aligned parallel to a direction of the frame 5*a* and the like. In FIG. 6, eight three-way valves 3*a* are aligned, but the number of the three-way valves 3*a* aligned is not limited to eight. In addition, an outflow pipe 3*m* and an inflow pipe 3*n* are connected to a main body of each three-way valve 3*a* (a three way valve main body 3*b* shown in FIGS. 11 and 12) and are arranged in a so-called staggered manner so as to be displaced by a half pitch, not aligned in a line in the up-down direction.

For example, in order to circulate the secondary heat medium between the indoor unit 12 shown in FIG. 1 and the heat medium relay unit 100, the outflow pipes 3*m* and the inflow pipes 3*n* are connected to the three-way valves 3*a*. Here, in the case where the heat medium relay unit 100 is mounted on a ceiling, after the drain pan 8 is removed, maintenance or the like is performed as described later. For example, in order to prevent the pipes closer to the ceiling from being unseen due to overlapping of the pipes when an operator looks up from below, the pipes are arranged in a staggered manner, thereby making it easy to see the pipes and the like and making it easy to confirm the pipes and the like.

Figure 11:
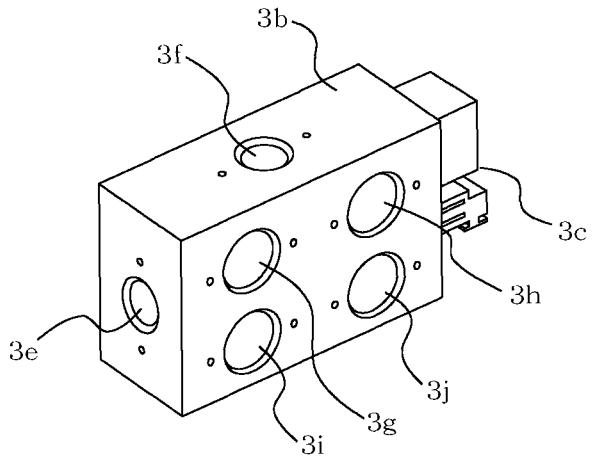
FIG. 11 is an external view of a three-way valve in the heat medium relay unit according to Embodiment 1 of the present invention.
Figure 12:
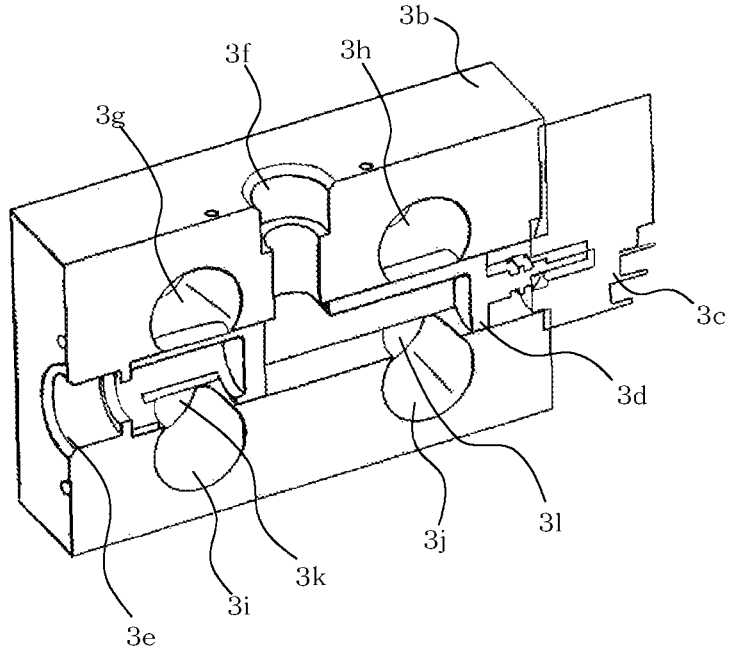
FIG. 12 is an internal structure diagram of the three-way valve in the heat medium relay unit according to Embodiment 1 of the present invention.

FIG. 11 is an external view of the three-way valve 3*a* of the heat medium relay unit 100 according to Embodiment 1. FIG. 12 is an internal structure diagram of the three-way valve 3*a* of the heat medium relay unit 100 according to Embodiment 1.

Each three-way valve 3*a* includes a three-way valve main body 3*b*, a three-way valve coil 3*c*, and a valve body 3*d*. The three-way valve main body 3*b* has an outflow port 3*e*, an inflow port 3*f*, and communication ports 3*g*, 3*h*, 3*i*, and 3*j* for the secondary heat medium. In the case where the three-way valves 3*a* are mounted so as to be stacked in parallel, the communication ports 3*g*, 3*h*, 3*i*, and 3*j* become flow paths for the secondary heat medium which is shared by each three-way valve.

The valve body 3*d* is inserted in a center hole of the three-way valve main body 3*b* and is connected to a shaft portion of the three-way valve coil 3*c*.

The three-way valve coil 3*c* is fixed to the three-way valve main body 3*b* and is structured such that the shaft portion thereof rotates. The valve body 3*d* is similarly structured so as to rotate with this rotation. The valve body 3*d* has a cylindrical shape and has openings 3*k* and 3*l* only in a range where there is a wall surface of a portion that contacts the communication ports 3*g*, 3*h*, 3*i*, and 3*j*.

The opening 3*k* is structured to be connected to the outflow port 3*e*, and the opening 3*l* is structured to be connected to the inflow port 3*f*, but the openings 3*k* and 3*l* do not communicate with each other. Thus, only when the opening 3*k*, the outflow port 3*e*, and either of the communication port 3*g* or 3*i* are connected to each other or the opening 3*l*, the inflow port 3*f*, and either of the communication port 3*h* or 3*j* are connected to each other, the secondary heat medium flows through each flow path such that the secondary heat medium circulates from the outflow port 3*e* of the three-way valve 3*a* through the indoor unit 12 and returns to the inflow port 3*f*.

With the above structure, for example, when the heated secondary heat medium is caused to flow through the communication ports 3*g* and 3*h* and the cooled heat medium is caused to flow through the communication ports 3*i* and 3*j*, the three-way valve coil 3*c* may be rotated such that the openings 3*k* and 3*l* of the valve body 3*d* are connected to the communication ports 3*g* and 3*h*. By so doing, the heated secondary heat medium flows through the communication pipes 16 and 17 and the communication port 3*g*, is sent via the opening 3*k*, the outflow port 3*e*, and the outflow pipe 3*m* to the indoor unit 12, flows through the inflow pipe 3*n*, the inflow port 3*f*, the opening 3*l*, the communication port 3*h*, and the communication pipes 16 and 17, and is returned to the secondary heat medium circuit.

In addition, if the three-way valve coil 3*c* is rotated such that the openings 3*k* and 3*l* of the valve body 3*d* are connected to the communication ports 3*i* and 3*j*, respectively, the cooled secondary heat medium flows through the communication pipes 16 and 17, the communication port 3*i*, and the opening 3*k*, and is sent via the outflow port 3*e* and the outflow pipe 3*m* to the indoor unit 12, passes through the inflow pipe 3*n*, the inflow port 3*f*, the opening 3*l*, the communication port 3*j*, and the communication pipes 16 and 17, and is returned to the secondary heat medium circuit.

In addition, it is possible to adjust the flow rate of the secondary heat medium by connecting the openings 3*k* and 3*l* and the communication ports 3*g*, 3*h*, 3*i*, and 3*j* to each other such that the openings 3*k* and 3*l* and the communication ports 3*g*, 3*h*, 3*i*, and 3*j* are slightly shifted from each other. In addition, it is possible to cause the communication ports 3*g* and 3*i* or 3*h* and 3*j* to partially communicate with each other, by increasing the sizes of the openings 3*k* and 3*l*. That is, the openings 3*k* and 3*l* are changeable in accordance with required capability and use application of the heat medium relay unit 100.

Next, the case of assembling the secondary heat medium flow path switching device 3 will be described.

First, the three-way valves 3*a* are assembled, and connected to each other, and the outflow pipe 3*m* and the inflow pipe 3*n* are attached to the outflow port 3*e* and the inflow port 3*f* of each three-way valve 3*a*. If these operations are performed in an unstable state, the efficiency is poor. Thus, the three-way valves 3*a* connected by using a jig are fixed in place, and the outflow pipes 3*m* and the inflow pipes 3*n* are attached thereto. Here, when the upper frames 5*a* and 5*b*, the inner panels 6*a* and 6*b*, and the placing plate 15 are assembled beforehand, it is possible to use the assembly as a jig for operation in manufacturing the secondary heat medium flow path switching device 3.

Figure 7:
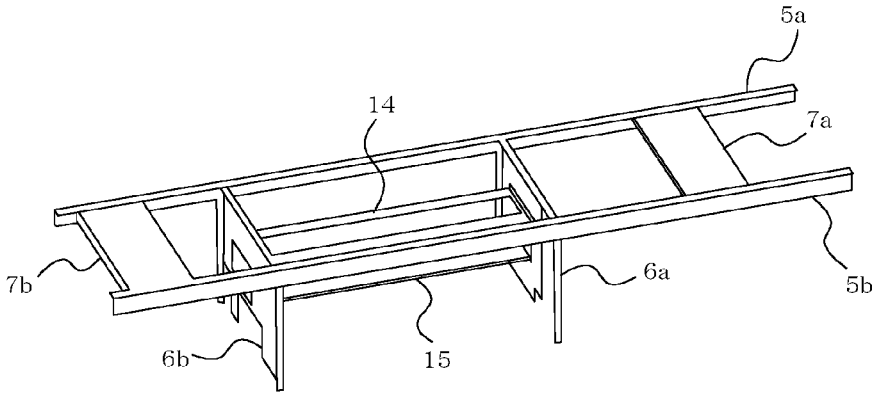
FIG. 7 is a structure diagram of only casing components of the secondary heat medium flow path switching device assembly of the heat medium relay unit according to Embodiment 1 of the present invention.

FIG. 7 is a structure diagram of only casing components of the secondary heat medium flow path switching device assembly of the heat medium relay unit 100. FIG. 7 shows a positional relationship among the frames 5*a* and 5*b*, the inner panels 6*a* and 6*b*, the support plates 7*a* and 7*b*, the presser plate 14, and the placing plate 15. The connected three-way valves 3*a* are structured so as to be able to be placed on the placing plate 15, and are structured such that the communication pipes 16 and 17 are connectable to the three-way valves 3*a* through the inner panels 6*a* and 6*b*.

By using this, the connected three-way valves 3*a* are placed on the placing plate 15, and are fixed by the presser plate 14 such that the presser plate 14 surrounds the three-way valves 3*a* are interposed between the presser plate 14 and the placing plate 15. The outflow pipe 3*m* and the inflow pipe 3*n* are attached to the outflow port 3*e* and the inflow port 3*f* of each of the three-way valves 3*a*, and the communication pipes 16 and 17 are attached thereto. By so doing, the secondary heat medium flow path switching device assembly is completed, and, for example, it is also possible to complete the water tightness test or the like as it is.

Figure 8:
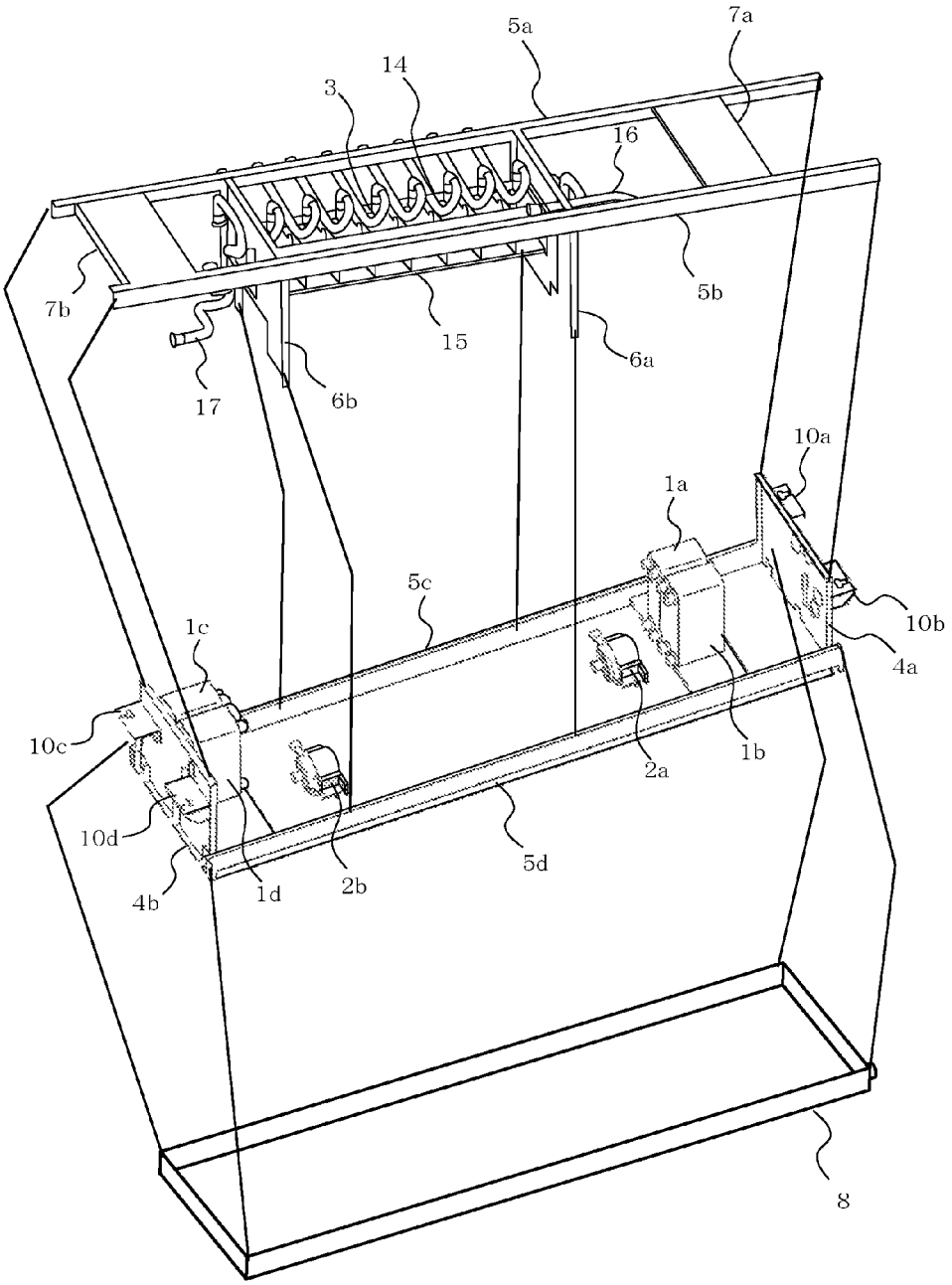
FIG. 8 is an assembly structure diagram of the primary heat medium assembly, the secondary heat medium flow path switching device assembly, and a drain pan of the heat medium relay unit according to Embodiment 1 of the present invention.

FIG. 8 is an assembly structure diagram of the primary heat medium assembly, the secondary heat medium flow path switching device assembly, and the drain pan 8 of the heat medium relay unit 100. Next, assembling of the primary heat medium side assembly shown in FIG. 4, the secondary heat medium flow path switching device assembly shown in FIG. 5, and the drain pan 8 will be described.

First, the side panels 4*a* and 4*b* and the frames 5*c* and 5*d* of the primary heat medium assembly and the frames 5*a* and 5*b* and the inner panels 6*a* and 6*b* of the secondary heat medium flow path switching device assembly are fixed to each other. At that time, the heat exchangers 1*a*, 1*b*, 1*c*, and 1*d* are interposed and fixed between the support plates 7*c* and 7*d* of the primary heat medium side assembly shown in FIG. 4 and the support plates 7*a* and 7*b* of the secondary heat medium flow path switching device assembly shown in FIG. 5.

Next, as shown in FIG. 3, the secondary heat medium flow path switching device 3, the heat exchangers 1*a*, 1*b*, 1*c*, and 1*d*, and the secondary heat medium sending devices 2*a* and 2*b* are connected to each other by pipes. At that time, by using the simple joints 13 for connection, it is made possible to easily attach and detach these components at the time of maintenance.

Figure 9:
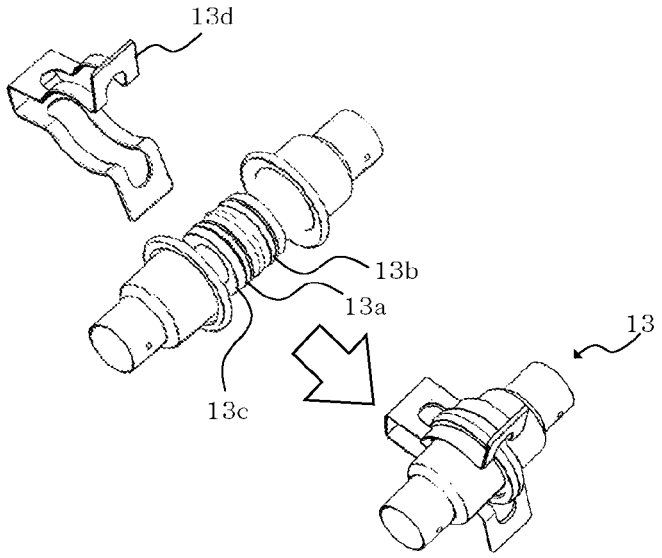
FIG. 9 is a detailed structure diagram of a simple joint of the heat medium relay unit according to Embodiment 1 of the present invention.

FIG. 9 is a detailed structure diagram of the simple joint 13 of the heat medium relay unit 100. The simple joint 13 includes both pipes each having an end portion with a flange shape, a collar 13*c* having O-rings 13*a* and 13*b* mounted on an outer periphery thereof, and a band 13*d*.

Next, a mounting method will be described.

First, the collar 13*c* receives both pipes. At that time, the O-rings 13*a* and 13*b* mounted on the outer periphery seal gaps between the inner surfaces of both pipes and the collar 13*c* so as to maintain water tightness unless the collar 13*c* comes out of the pipes. At that time, the flange portions at end surfaces of both pipes are in close contact with each other, and the band 13*d* is mounted at that position. The band 13*d* is provided with slits. When the band 13*d* is mounted, the flange portions are interposed and fixed between the slits. The slits are hooked on the flange portions of both pipes which are in close contact with each other, so that the pipes are not separated from each other. Thus, unless the band 13*d* is dismounted, water does not leak due to the pipes being separated from each other such that the collar 13*c* comes out.

The band 13*d* is in close contact with the pipes in a circumferential direction thereof by its own elastic force. For example, if the liquid pressure of the secondary heat medium is much lower than the rigidity of each pipe, it suffices that the pipes do not deform in a direction in which the band 13*d* is widened, and flange portions of both pipes fixed by the slits are not separated from each other. Thus, the elastic force of the band 13*d* is such a force that the band 13*d* is allowed to be mounted/dismounted with a force of human fingers.

The simple joints 13 are used for pipe connection between the communication pipes 16 and 17, the secondary heat medium sending devices 2*a* and 2*b*, and the heat exchangers 1*a*, 1*b*, 1*c*, and 1*d*, etc., whereby it is possible to easily separate only the secondary heat medium flow path switching device 3 from the pipe circuit.

Lastly, the drain pan 8 is fixed to the lower frames 5*c* and 5*d* shown in FIG. 4 etc. Then, a water tightness test is conducted on the pipes connected by the simple joint 13 shown in FIG. 9. In this manner, the heat medium relay unit is assembled.

As described above, the heat medium relay unit 100 according to Embodiment 1 is structured such that it is possible to mount the drain pan 8 at the final step in assembling. This is for maintaining workability by enabling an operation to be performed from the bottom, since a situation where it is difficult to cause a hand to enter into the unit interior is provided as the process of assembling proceeds, due to the heat medium relay unit 100 being designed to be narrow. In addition, since the heat medium relay unit 100 is structured such that it is possible to mount the drain pan 8 at the final step in assembling, it is possible to dismount the drain pan 8 at first in maintenance, and it is possible to have a view of the unit interior from the bottom side. Thus, it is also possible to easily confirm a location where breakdown occurs before maintenance.

Next, regarding the heat medium relay unit 100 according to Embodiment 1, a maintenance method and the like in the case where the necessity of maintenance of the functional component at the primary heat medium side forming the primary heat medium side assembly arises after the heat medium relay unit 100 is installed at a ceiling, will be described. Here, the heat medium relay unit 100 is installed by being fastened via the hanging metal fittings 10*a*, 10*b*, 10*c*, and 10*d* shown in FIG. 8 etc., by means of bolts or the like projecting from the ceiling at the actual place with nuts or the like.

As a procedure of disassembling the assembled heat medium relay unit 100 in order to perform maintenance on the primary heat medium side assembly, first, the fixing of the drain pan 8 and the lower frames 5*c* and 5*d* shown in FIG. 8 are released to dismount the drain pan 8. Next, the simple joints 13 with which the secondary heat medium flow path switching device 3; and the heat exchangers 1*a*, 1*b*, 1*c*, and 1*d* and the secondary heat medium sending devices 2*a* and 2*b* are connected by pipes, are removed. Then, the fixing of the side panels 4*a* and 4*b*, the frames 5*c* and 5*d*, the inner panels 6*a* and 6*b*, and the lower frames 5*c* and 5*d* are released.

Figure 10:
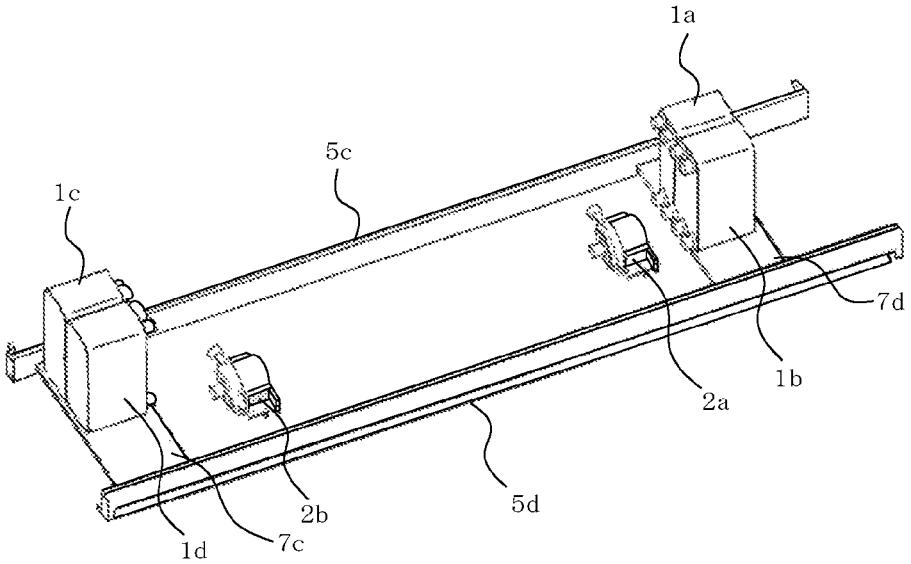
FIG. 10 is a diagram showing the structure of the primary heat medium side assembly regarding disassembly of the heat medium relay unit according to Embodiment 1 of the present invention.

FIG. 10 is a diagram showing the structure of the primary heat medium side assembly regarding disassembly of the heat medium relay unit 100. As shown in FIG. 10, some components are dismounted such that the configuration includes the heat exchangers 1*a*, 1*b*, 1*c*, and 1*d*, the frames 5*c* and 5*d*, the support plates 7*c* and 7*d*, and the secondary heat medium sending devices 2*a* and 2*b*.

Thus, the component configuration of the primary heat medium side assembly to be dismounted does not include the side panels 4*a* and 4*b*, unlike FIG. 4. Accordingly, it is possible to cause the side panels 4*a* and 4*b*, which are fixed to the hanging metal fittings 10*a*, 10*b*, 10*c*, and 10*d*, to remain in order to support the frames 5*a* and 5*b* of the secondary heat medium flow path switching device assembly shown in FIG. 5. As a result, in the heat medium relay unit 100 according to Embodiment 1, in a state where the secondary heat medium flow path switching device 3 remains at the ceiling, it is possible to dismount only the functional components at the primary heat medium side from the ceiling. Therefore, a heat insulator and the pipe with the indoor unit 12 in FIG. 1, which is connected to the secondary heat medium flow path switching device 3, may not be dismounted, and thus it is possible to shorten a recovery time until completion of maintenance.

Here, in order to enable this structure, it is necessary to provide a structure in which the secondary heat medium flow path switching device 3 is disposed at the uppermost portion of the heat medium relay unit 100, such that the secondary heat medium flow path switching device 3 does not become an obstacle to dismounting the functional components at the primary heat medium side.

As described above, the heat medium relay unit 100 according to Embodiment 1 includes the drain pan 8 which has width and depth dimensions larger than the outer dimensions of the heat medium relay unit main body including the side panels 4*a* and 4*b*, the 5*a* and 5*b*, and the lower frames 5*c* and 5*d*, and has a rising portion which is higher than the upper end surface of each lower frame. Thus, according to the heat medium relay unit 100, it is possible to receive dew condensation water on the outer surface of the heat medium relay unit or leak water coming out of the interior of the heat medium relay unit through the gap and the lower frames 5*c* and 5*d* and the outer shell component covering a side surface, such as the service panel 9, to the outside of the heat medium relay unit, without leaking the water to the outside of the unit.

As a result, it is possible to prevent an increase in the size of the unit and a decrease in assembly workability and maintainability due to use of many heat insulators and sealing materials.

In addition, the heat medium relay unit 100 is configured by assembling and combining the primary heat medium side assembly including the configured heat exchangers 1*a*, 1*b*, 1*c*, and 1*d* and secondary heat medium sending devices 2*a* and 2*b*, the secondary heat medium flow path switching device assembly including the secondary heat medium flow path switching device 3, such that the secondary heat medium flow path switching device assembly side is the upper side. Thus, according to the heat medium relay unit 100, for example, at the time of maintenance, it is possible to easily split (separate) the primary heat medium assembly and the secondary heat medium flow path switching device assembly. In particular, in the case where the heat medium relay unit 100 is hanged from a ceiling or the like such that the secondary heat medium flow path switching device assembly is disposed higher than the primary heat medium side assembly, it is possible to easily dismount components at the primary heat medium side which take time and effort to dismount the components, from the lower side, and it is possible to easily perform maintenance.

Furthermore, since the plurality of heat exchangers 1*a*, 1*b*, 1*c*, and 1*d*, which are heavy components, are provided at both end portions of the unit, a load is distributed, and it is possible to keep balance in the unit. Since the drain pan 8 is mounted to the primary heat medium side assembly at the final step in assembling the unit, for example, in maintenance, it is possible to dismount the drain pan 8 at first, thus it is possible to shorten the time of disassembly, and it is also possible to easily clean the drain pan 8 itself.

Moreover, when the primary heat medium side assembly is dismounted after the heat medium relay unit 100 is installed, it is possible to leave the side panels 4*a* and 4*b* including the hanging metal fittings 10*a*, 10*b*, 10*c*, and 10*d*, together with the secondary heat medium flow path switching device assembly. Thus, according to the heat medium relay unit 100, it is possible to keep the secondary heat medium flow path switching device assembly installed at the ceiling. Furthermore, in the method for installing the frame 5*a* and the like, the outflow pipes 3*m* and the inflow pipes 3*n*, which are connected to the indoor unit 12, are disposed in a so-called staggered manner, and thus it is possible to make it easy to see the pipes and the like and make it easy to confirm the pipes and the like in maintenance or the like.

Since the pipes between the secondary heat medium flow path switching device 3, the heat exchangers 1*a*, 1*b*, 1*c*, and 1*d*, and the secondary heat medium sending devices 2*a* and 2*b* are connected by using the simple joints 13, inserting the collar 13*c*, and interposing the flanges at the pipe connection portion with the band 13*d*, for example, it is possible to easily attach and detach the pipes at the time of maintenance.

It is possible to assemble and use the frames 5*a* and 5*b*, the inner panels 6*a* and 6*b*, the support plates 7*a* and 7*b*, and the placing plate 15 as a jig in manufacturing the secondary heat medium flow path switching device 3. Thus, according to the heat medium relay unit 100, it is not necessary to produce a new jig, and it is possible to shorten the time of assembling, or the like. In addition, since the heat medium relay unit 100 is manufactured by individually forming the primary heat medium assembly and the secondary heat medium flow path switching device assembly, and combining these assemblies, it is possible to individually conduct an air tightness test and a water tightness test, and thus, for example, it is possible to shorten the test time and the manufacturing time and improve safety of the tests and the yield.

Embodiment 2

Figure 13:
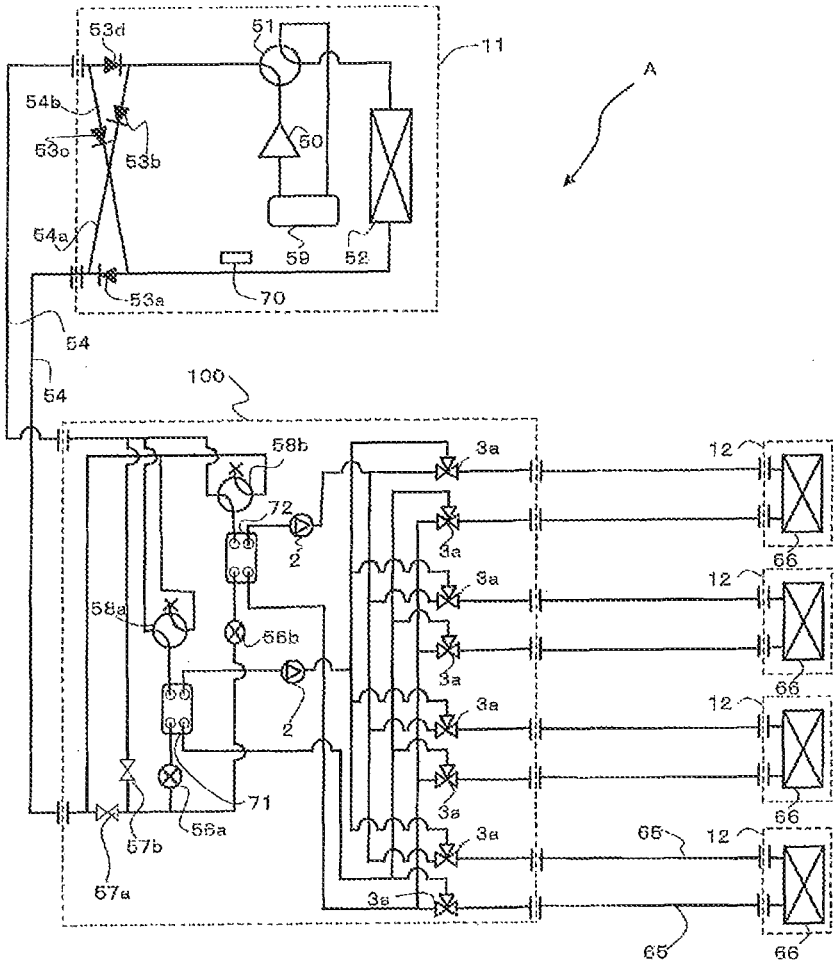
FIG. 13 is a schematic circuit configuration diagram showing an example of the circuit configuration of an air-conditioning apparatus according to Embodiment 2 of the present invention.

FIG. 13 is a schematic circuit configuration diagram showing an example of the circuit configuration of an air-conditioning apparatus (hereinafter, referred to as air-conditioning apparatus A) according to Embodiment 2 of the present invention. The detailed configuration of the air-conditioning apparatus A will be described based on FIG. 13. The air-conditioning apparatus A includes the heat medium relay unit 100 according to Embodiment 1. In Embodiment 2, the difference from Embodiment 1 will be mainly described, the same portions as those in Embodiment 1 are designated by the same reference signs, and the description thereof is omitted.

As shown in FIG. 13, in the air-conditioning apparatus A, the outdoor unit 11 and the heat medium relay unit 100 are connected to each other by refrigerant pipes 54 via an intermediate heat exchanger 71 and an intermediate heat exchanger 72 provided in the heat medium relay unit 100. In addition, the heat medium relay unit 100 and each indoor unit 12 are also connected to each other by pipes 65 via the intermediate heat exchanger 71 and the intermediate heat exchanger 72.

The intermediate heat exchanger 71 corresponds to the heat exchangers 1*a* and 1*b* described in Embodiment 1, and the intermediate heat exchanger 72 corresponds to the heat exchangers 1*c* and 1*d* described in Embodiment 1.

The pipes 65 correspond to the outflow pipes 3*m* and the inflow pipes 3*n* described in Embodiment 1.

{Configuration of Air-conditioning Apparatus A}

[Outdoor Unit 11]

The outdoor unit 11 includes a compressor 50, a first refrigerant flow path switching device 51 such as a four-way valve, a heat source side heat exchanger 52, and an accumulator 59 which are connected in series by the refrigerant pipes 54. In addition, the outdoor unit 11 is provided with a first connection pipe 54*a*, a second connection pipe 54*b*, a check valve 53*a*, a check valve 53*b*, a check valve 53*c*, and a check valve 53*d*. Since the first connection pipe 54*a*, the second connection pipe 54*b*, the check valve 53*a*, the check valve 53*b*, the check valve 53*c*, and the check valve 53*d* are provided, it is possible to direct flow of the primary heat medium caused to flow through the heat medium relay unit 100, in a given direction regardless of an operation requested by the indoor unit 12.

The compressor 50 sucks the primary heat medium and compresses the primary heat medium into a high-temperature high-pressure state. The compressor 50 may be composed of, for example, a capacity-controllable inverter compressor or the like. The first refrigerant flow path switching device 51 switches between flow of the primary heat medium during heating operation (in a heating only operation mode, in a heating main operation mode) and flow of the primary heat medium during cooling operation (in a cooling only operation mode, in a cooling main operation mode).

The heat source side heat exchanger 52 serves as an evaporator during heating operation, serves as a condenser (or a radiator) during cooling operation, and exchanges heat between air sent from an air-sending device, such as a fan, which is not shown and the primary heat medium to evaporate and gasify or condense and liquify the primary heat medium. The accumulator 59 is provided at the suction side of the compressor 50 and serves to store excess refrigerant due to a difference between during heating operation and during cooling operation, or excess refrigerant for transient change in operation.

The check valve 53*d* is provided on the refrigerant pipe 54 between the heat medium relay unit 100 and the first refrigerant flow path switching device 51, and permits flow of the primary heat medium only in a predetermined direction (a direction from the heat medium relay unit 100 to the outdoor unit 11). The check valve 53*a* is provided on the refrigerant pipe 54 between the heat source side heat exchanger 52 and the heat medium relay unit 100, and permits flow of the primary heat medium only in a predetermined direction (a direction from the outdoor unit 11 to the heat medium relay unit 100). The check valve 53*b* is provided on the first connection pipe 54*a*, and causes the primary heat medium discharged from the compressor 50 during heating operation to flow through the heat medium relay unit 100. The check valve 53*c* is provided on the second connection pipe 54*b*, and causes the primary heat medium returning from the heat medium relay unit 100 during heating operation to flow to the suction side of the compressor 50.

The first connection pipe 54*a* connects the refrigerant pipe 54 between the first refrigerant flow path switching device 51 and the check valve 53*d* to the refrigerant pipe 54 between the check valve 53*a* and the heat medium relay unit 100 within the outdoor unit 11. The second connection pipe 54*b* connects the refrigerant pipe 54 between the check valve 53*d* and the heat medium relay unit 100 to the refrigerant pipe 54 between the heat source side heat exchanger 52 and the check valve 53*a* within the outdoor unit 11. FIG. 2 shows the case where the first connection pipe 54*a*, the second connection pipe 54*b*, the check valve 53*a*, the check valve 53*b*, the check valve 53*c*, and the check valve 53*d* are provided, but the configuration is not limited thereto, and these components may not necessarily need to be provided.

[Indoor Units 12]

Each indoor unit 12 is equipped with a use side heat exchanger 66. The use side heat exchanger 66 is connected to the three-way valves 3*a* of the heat medium relay unit 100 by the pipes 65. The use side heat exchanger 66 exchanges heat between air sent from an air-sending device, such as a fan, which is not shown and the secondary heat medium to generate heating air or cooling air to be sent to an indoor space 7.

FIG. 2 shows the case where four indoor units 12 are connected to the heat medium relay unit 100. The number of the indoor unit 12 connected is not limited to four shown in FIG. 2. In this case, eight three-way valves 3*a* suffice to be connected in the heat medium relay unit 100.

[Heat Medium Relay Unit 100]

The heat medium relay unit 100 is equipped with the intermediate heat exchanger 71, the intermediate heat exchanger 72, two expansion devices 56, two opening/closing devices 57, two second refrigerant flow path switching devices 58, two secondary heat medium sending devices 2, and the eight three way valves 8*a*. The expansion devices 56, the opening/closing devices 57, and the second refrigerant flow path switching devices 58 are not shown in Embodiment 1.

The two expansion devices 56 (an expansion device 56*a*, an expansion device 56*b*) have a function as a pressure reducing valve or an expansion valve, and serve to reduce the pressure of the primary heat medium to expand the primary heat medium. The expansion device 56*a* is provided at the upstream side of the intermediate heat exchanger 71 in the flow of the primary heat medium during cooling operation. The expansion device 56*b* is provided at the upstream side of the intermediate heat exchanger 72 in the flow of the primary heat medium during cooling operation. The two expansion devices 56 may be each composed of one whose opening degree is variably controllable, for example, an electronic expansion valve or the like.

The two opening/closing devices 57 (an opening/closing device 57*a*, and an opening/closing device 57*b*) are each composed of a two-way valve or the like, and open and close the refrigerant pipe 54. The opening/closing device 57*a* is provided on the refrigerant pipe 54 at the inlet side of the primary heat medium. The opening/closing device 57*b* is provided on a pipe connecting the refrigerant pipes 54 at the inlet side and the outlet side of the primary heat medium.

The two second refrigerant flow path switching devices 58 (a second refrigerant flow path switching device 58*a*, a second refrigerant flow path switching device 58*b*) are each composed of, for example, a four-way valve or the like, and switch flow of the primary heat medium in accordance with an operation mode. The second refrigerant flow path switching device 58*a* is provided at the downstream side of the intermediate heat exchanger 71 in the flow of the primary heat medium during cooling operation. The second refrigerant flow path switching device 58*b* is provided at the downstream side of the intermediate heat exchanger 72 in the flow of the primary heat medium in the cooling only operation mode.

The eight three-way valves 3*a* switch a flow path for the secondary heat medium. The number of (here, eight) the three-way valves 3*a* which is set in accordance with the number of the provided indoor units 12 are provided. Each three-way valve 3*a* is connected at one of the three ways to the intermediate heat exchanger 71, is connected at another one of the three ways to the intermediate heat exchanger 72, and is connected at the other one of the three ways to the use side heat exchanger 66. The three-way valves 3*a* are provided at an outlet side and an inlet side of the secondary heat medium flow path of the corresponding use side heat exchangers 66. Switching of the secondary heat medium flow path includes not only complete switching from one to another but also partial switching from one to another. The configuration of each three-way valve 3*a* is as described in Embodiment 1.

In addition, the air-conditioning apparatus A includes a controller 70. The controller 70 is composed of a microcomputer or the like. Based on detection information at various detection means, which are not shown, and an instruction from a remote controller, the controller 70 controls the driving frequency of the compressor 50, a rotation speed (including ON/OFF) of the air-sending device, switching of the first refrigerant flow path switching device 51, driving of the secondary heat medium sending devices 2, the opening degrees of the expansion devices 56, opening/closing of the opening/closing devices 57, switching of the second refrigerant flow path switching devices 58, switching of the three-way valves 3*a*, driving of a heat medium flow control device 25, etc., to execute each operation mode. The state where the controller 70 is installed in the outdoor unit 11 is shown as an example, but the installation place is not particularly limited.

The pipes 65 which pass the secondary heat medium therethrough include one connected to the intermediate heat exchanger 71 and one connected to the intermediate heat exchanger 72. The pipes 65 are each branched (here, branched into four portions) in accordance with the number of the indoor units 12 connected to the heat medium relay unit 100. The pipes 65 are connected by the three-way valves 3*a*. By controlling the three-way valves 3*a*, whether to cause the secondary heat medium from the intermediate heat exchanger 71 to flow into the use side heat exchanger 66 or cause the secondary heat medium from the intermediate heat exchanger 72 to flow into the use side heat exchanger 66, is determined.

In the air-conditioning apparatus A, the compressor 50, the first refrigerant flow path switching device 51, the heat source side heat exchanger 52, the opening/closing devices 57, the second refrigerant flow path switching devices 58, primary heat medium flow paths of the intermediate heat exchangers 71 and 72, the expansion devices 56, and the accumulator 59 are connected to each other by the refrigerant pipes 54 to form a primary heat medium circulation circuit. In addition, secondary heat medium flow paths of the intermediate heat exchangers 71 and 72, the secondary heat medium sending devices 2, the three way valves 3*a* at the inlet side, the heat medium flow control device 25, the use side heat exchangers 66, and the three-way valves 3*a* at the outlet side are connected to each other by the pipes 65 to form a secondary heat medium circulation circuit. That is, a plurality of the use side heat exchangers 66 are connected in parallel to the intermediate heat exchanger 71, to make the secondary heat medium circulation circuit as a plurality of systems.

Thus, in the air-conditioning apparatus A, the outdoor unit 11 and the heat medium relay unit 100 are connected to each other via the intermediate heat exchanger 71 and the intermediate heat exchanger 72, which are provided in the heat medium relay unit 100, and the heat medium relay unit 100 and the indoor units 12 are also connected to each other via the intermediate heat exchanger 71 and the intermediate heat exchanger 72. That is, in the air-conditioning apparatus A, the intermediate heat exchanger 71 and the intermediate heat exchanger 72 exchange heat between the primary heat medium circulating in the primary heat medium circulation circuit and the secondary heat medium circulating in the secondary heat medium circulation circuit.

Since the air-conditioning apparatus A includes the heat medium relay unit 100 according to Embodiment 1 as described above, it is possible to easily produce the air-conditioning apparatus A and perform maintenance on the air-conditioning apparatus A. In addition, according to the air-conditioning apparatus A, flexibility in the installation location of the heat medium relay unit 100 increases, and the air-conditioning apparatus A is applicable to various buildings.

REFERENCE SIGNS LIST

1*a* heat exchanger 1*b* heat exchanger 1*c* heat exchanger 1*d* heat exchanger 2 secondary heat medium sending device

2*a* secondary heat medium sending device 2*b* secondary heat medium sending device 3 secondary heat medium flow path switching device 3*a* three-way valve 3*b* three-way valve main body 3*c* three-way valve coil 3*d* valve body 3*e* outflow port 3*f* inflow port 3*g* communication port 3*h* communication port 3*i* communication port 3*j* communication port 3*k* opening 3*l* opening 3*m* outflow pipe 3*n* inflow pipe 4*a* side panel 4*b* side panel 5*a* frame 5*b* frame 5*c* frame 5*d* frame 6*a* inner panel 6*b* inner panel 7 indoor space 7*a* support plate 7*b* support plate 7*c* support plate 7*d* support plate 8 drain pan 9 service panel 10*a* hanging metal fitting 10*b* hanging metal fitting 10*c* hanging metal fitting 10*d* hanging metal fitting 11 outdoor unit 12 indoor unit 13 simple joint 13*a* O-ring 13*b* O-ring 13*c* collar 13*d* band 14 presser plate 15 placing plate 16 communication pipe 17 communication pipe 25 heat medium flow control device 50 compressor 51 first refrigerant flow path switching device 52 heat source side heat exchanger 53*a* check valve 53*b* check valve 53*c* check valve 53*d* check valve 54 refrigerant pipe 54*a* first connection pipe 54*b* second connection pipe 56 expansion device 56*a* expansion device 56*b* expansion device 57 opening/closing device 57*a* opening/closing device 57*b* opening/closing device 58 second refrigerant flow path switching device 58*a* second refrigerant flow path switching device 58*b* second refrigerant flow path switching device 59 accumulator 65 pipe 66 use side heat exchanger 70 controller 71 intermediate heat exchanger 72 intermediate heat exchanger 100 heat medium relay unit 100*a* casing A air-conditioning apparatus

The invention claimed is:

1. A heat medium relay unit comprising a primary heat medium side assembly, a secondary heat medium flow path switching device assembly, and a drain pan, the primary heat medium side assembly including a heat exchanger configured to exchange heat between a primary heat medium and a secondary heat medium, the primary heat medium circulating between the heat medium relay unit and an outdoor unit connected by a pipe, the secondary heat medium circulating between the heat medium relay unit and an indoor unit connected by a pipe;

a secondary heat medium sending device configured to pump the secondary heat medium for circulating between the heat medium relay unit and the indoor unit; and a primary-side casing portion including side panels covering side surfaces of the heat medium relay unit, and lower frames that connect between the side panels and to which the secondary heat medium sending device is attached, the secondary heat medium flow path switching device assembly including a secondary heat medium flow path switching device configured to select or mix the secondary heat medium flowing through a plurality of flow paths, and cause the secondary heat medium to flow into and out of the indoor unit; and a secondary-side casing portion including upper frames connecting between the side panels, the drain pan being configured to have width and depth dimensions larger than dimensions of an outer shell of a heat medium relay unit main body, the outer shell including the side panels, the upper frames, and the lower frames, an upper end surface whose position is higher than that of an upper end surface of the lower frames, and the secondary heat medium flow path switching device assembly, the primary heat medium side assembly, and the drain pan are disposed in a named order from an upper side.

2. The heat medium relay unit of claim 1, wherein the side panels each have a hanging metal fitting for mounting the unit such that the unit is installable from the upper side, and are attachable to and detachable from the primary heat medium side assembly for allowing the secondary heat medium flow path switching device assembly to be retained at a position at which the secondary heat medium flow path switching device assembly is mounted with the hanging metal fitting.

3. The heat medium relay unit of claim 1, wherein the secondary-side casing portion is configured to serve as a jig in manufacturing the secondary heat medium flow path switching device.

4. The heat medium relay unit of claim 1, wherein a flange is provided at a pipe connection portion between the heat exchanger or the secondary heat medium sending device and the secondary heat medium flow path switching device, and a collar having an O-ring mounted at an outer side thereof is disposed in the pipe connection portion to connect each pipe, and the flange at each pipe connection portion is retained by a band having a slit and retained in the slit, to connect and fix the pipes to each other.

5. The heat medium relay unit of claim 1, wherein the drain pan is mounted at a lower side of the primary heat medium side assembly in a final step in assembling the unit.

6. The heat medium relay unit of claim 1, wherein the heat exchanger is one of a plurality of heat exchangers, and the heat exchangers are separately arranged at both end portions of the unit inside the side panels.

7. The heat medium relay unit of claim 1, wherein in the secondary heat medium flow path switching device, an outflow pipe through which the secondary heat medium flows out and an inflow pipe through which the secondary heat medium flows in are connected in a staggered manner in a direction of the frames.

8. The heat medium relay unit of claim 1, wherein the heat medium relay unit is assembled after an air tightness test on the primary heat medium side assembly and an air tightness test on the secondary heat medium flow path switching device assembly are conducted.

9. The heat medium relay unit of claim 1, wherein the heat medium relay unit is part of an air conditioning apparatus that includes:

an outdoor unit configured to supply cooling energy or heating energy; and an indoor unit configured to cool or heat a heat medium with the cooling energy or the heating energy from the outdoor unit and execute air-conditioning of an air-conditioning target space with the heat medium, wherein the heat medium relay unit is interposed between the outdoor unit and the indoor unit.

10. The heat medium relay unit of claim 1, wherein the casing includes a plurality of hanging metal fittings, which are configured to hang the heat medium relay unit from a ceiling so that a lower surface of the drain pan faces downward, and the drain pan is configured to be removed so that maintenance of the heat relay unit is performed from below the heat medium relay unit.

11. A heat medium relay unit comprising a primary heat medium side assembly, a secondary heat medium flow path switching device assembly, and a drain pan, the primary heat medium side assembly including a heat exchanger configured to exchange heat between a primary heat medium and a secondary heat medium, the primary heat medium circulating between the heat medium relay unit and an outdoor unit connected by a pipe, the secondary heat medium circulating between the heat medium relay unit and an indoor unit connected by a pipe;

a secondary heat medium sending device configured to pump the secondary heat medium for circulating between the heat medium relay unit and the indoor unit; and a primary-side casing portion including side panels covering side surfaces of the heat medium relay unit, and lower frames that connect between the side panels and to which the secondary heat medium sending device is attached, the secondary heat medium flow path switching device assembly including a secondary heat medium flow path switching device configured to select or mix the secondary heat medium flowing through a plurality of flow paths, and cause the secondary heat medium to flow into and out of the indoor unit; and a secondary-side casing portion including upper frames connecting between the side panels, the drain pan being configured to have width and depth dimensions larger than dimensions of an outer shell of a heat medium relay unit main body, the outer shell including the side panels, the upper frames, and the lower frames, and an upper end surface whose position is higher than that of an upper end surface of the lower frames, wherein the secondary heat medium flow path switching device assembly is located at an uppermost portion of the heat medium relay unit, and the heat exchanger is located at a lower side of the casing, so that the heat exchanger is accessible for maintenance from the bottom of the heat medium relay unit when the drain pan is removed without interference by the secondary heat medium flow path switching device assembly.

12. The heat medium relay unit of claim 11, wherein the side panels each have a hanging metal fitting for mounting the unit such that the unit is installable from the upper side, and are attachable to and detachable from the primary heat medium side assembly for allowing the secondary heat medium flow path switching device assembly to be retained at a position at which the secondary heat medium flow path switching device assembly is mounted with the hanging metal fitting.

13. The heat medium relay unit of claim 11, wherein the secondary-side casing portion is configured to serve as a jig in manufacturing the secondary heat medium flow path switching device.

14. The heat medium relay unit of claim 11, wherein a flange is provided at a pipe connection portion between the heat exchanger or the secondary heat medium sending device and the secondary heat medium flow path switching device, a collar having an O-ring mounted at an outer side thereof is disposed in the pipe connection portion to connect each pipe, and the flange at each pipe connection portion is retained by a band having a slit and retained in the slit, to connect and fix the pipes to each other.

15. The heat medium relay unit of claim 11, wherein the drain pan is mounted at a lower side of the primary heat medium side assembly in a final step in assembling the unit.

16. The heat medium relay unit of claim 11, wherein the heat exchanger is one of a plurality of heat exchangers, and the heat exchangers are separately arranged at both end portions of the unit inside the side panels.

17. The heat medium relay unit of claim 11, wherein in the secondary heat medium flow path switching device, an outflow pipe through which the secondary heat medium flows out and an inflow pipe through which the secondary heat medium flows in are connected in a staggered manner in a direction of the frames.

18. The heat medium relay unit of claim 11, wherein the heat medium relay unit is assembled after an air tightness test on the primary heat medium side assembly and an air tightness test on the secondary heat medium flow path switching device assembly are conducted.

19. The heat medium relay unit of claim 11, wherein the heat medium relay unit is part of an air conditioning apparatus that includes:

an outdoor unit configured to supply cooling energy or heating energy; and an indoor unit configured to cool or heat a heat medium with the cooling energy or the heating energy from the outdoor unit and execute air-conditioning of an air-conditioning target space with the heat medium, wherein the heat medium relay unit is interposed between the outdoor unit and the indoor unit.

20. The heat medium relay unit of claim 11, wherein the casing includes a plurality of hanging metal fittings, which are configured to hang the heat medium relay unit from a ceiling so that a lower surface of the drain pan faces downward, and the drain pan is configured to be removed so that maintenance of the heat relay unit is performed from below the heat medium relay unit.

* * * * *